US009545155B2

(12) United States Patent
James

(10) Patent No.: US 9,545,155 B2
(45) Date of Patent: Jan. 17, 2017

(54) FLOOR SEAT

(71) Applicant: Louise James, Poole (GB)

(72) Inventor: Louise James, Poole (GB)

( * ) Notice: Subject to any disclaimer, the term of this patent is extended or adjusted under 35 U.S.C. 154(b) by 0 days.

(21) Appl. No.: 14/690,161

(22) Filed: Apr. 17, 2015

(65) Prior Publication Data

US 2016/0353892 A1 Dec. 8, 2016

(51) Int. Cl.
*A47C 3/16* (2006.01)
*A47C 15/00* (2006.01)

(52) U.S. Cl.
CPC ..... *A47C 3/16* (2013.01); *A47C 15/004* (2013.01)

(58) Field of Classification Search
CPC ..... A47C 7/021; A47C 3/16; A47C 15/004
USPC ..... 5/653, 654; 297/4
See application file for complete search history.

(56) References Cited

U.S. PATENT DOCUMENTS

| | | | | |
|---|---|---|---|---|
| 679,915 | A * | 8/1901 | Rudolf | 5/653 |
| 4,673,216 | A * | 6/1987 | Alfer | 297/452.27 |
| 5,026,585 | A * | 6/1991 | Funatogawa | 428/71 |
| 5,134,740 | A * | 8/1992 | Summer | 5/652 |
| 5,402,545 | A * | 4/1995 | Jolley | 5/653 |
| 6,581,227 | B1 * | 6/2003 | Obermaier | 5/654 |
| 7,024,712 | B2 * | 4/2006 | Fujita et al. | 5/653 |
| 7,966,679 | B2 * | 6/2011 | Sakata et al. | 5/653 |
| 8,677,532 | B2 * | 3/2014 | Legare | 5/652 |
| 2002/0124318 | A1 * | 9/2002 | Loomos | 5/653 |
| 2003/0101514 | A1 * | 6/2003 | Roberson | 5/632 |
| 2004/0055091 | A1 * | 3/2004 | Sedan | 5/653 |
| 2012/0124749 | A1 * | 5/2012 | Lewman | 5/653 |
| 2014/0259426 | A1 * | 9/2014 | Pearce | 5/653 |

FOREIGN PATENT DOCUMENTS

| | | |
|---|---|---|
| DE | 102004010573 | 6/2008 |
| WO | 2006134191 | 12/2006 |
| WO | 2012036188 | 3/2012 |

* cited by examiner

*Primary Examiner* — David E Sosnowski
*Assistant Examiner* — Eric Kurilla
(74) *Attorney, Agent, or Firm* — Boulware & Valoir

(57) ABSTRACT

A floor seat providing a pair of sitting-bone supports, a pelvic-floor support extending between the sitting-bone supports at substantially the same level, a coccyx indent behind the pelvic-floor support, a heel indent in front of the pelvic-floor support, and a forward incline, which provide positioning, cushioning, insulation, and the proper amount of supporting pressure or absence of pressure appropriate to the sitting bones, the pelvic floor, and the coccyx, and room for proper placement of the feet, for persons sitting on a floor, particularly though not exclusively in the practice of yoga, and optionally a pubic-bone positioner to aid in positioning and posture, and thigh supports.

20 Claims, 5 Drawing Sheets

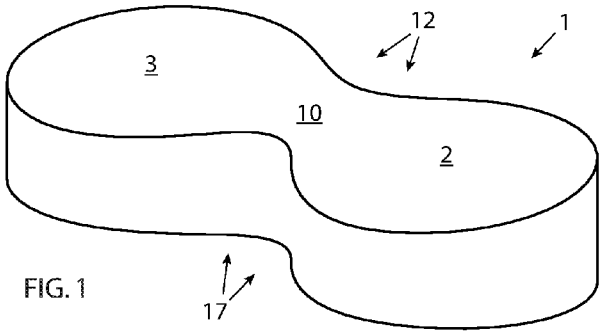
FIG. 1
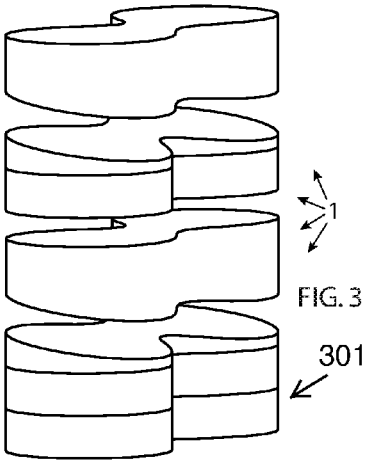
FIG. 3
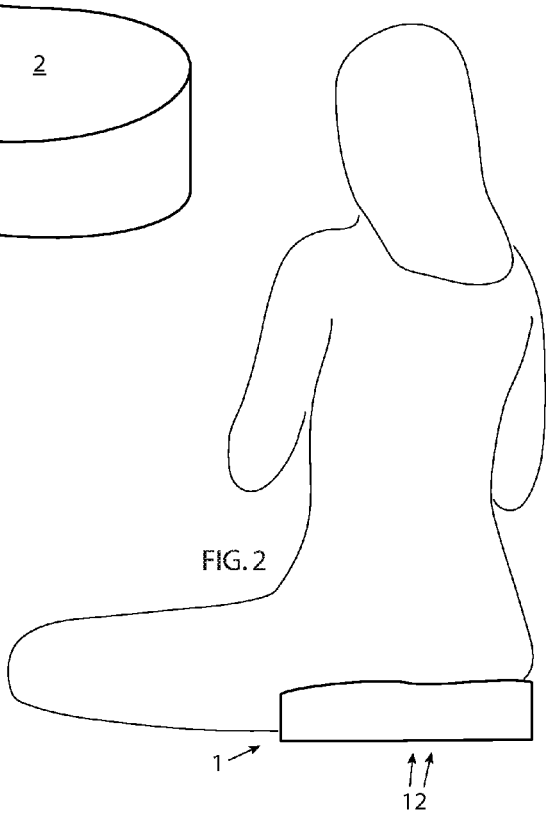
FIG. 2
FIG. 4
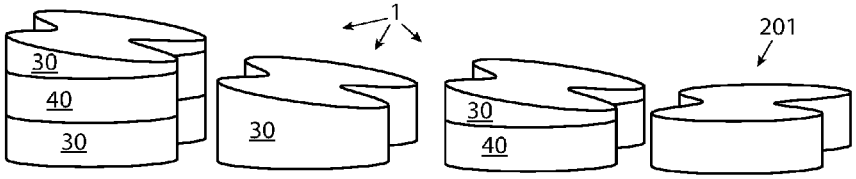
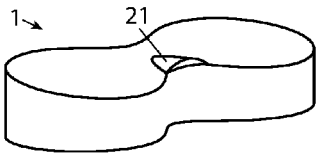
FIG. 5
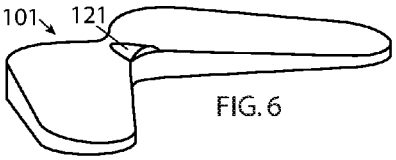
FIG. 6

FIG. 7
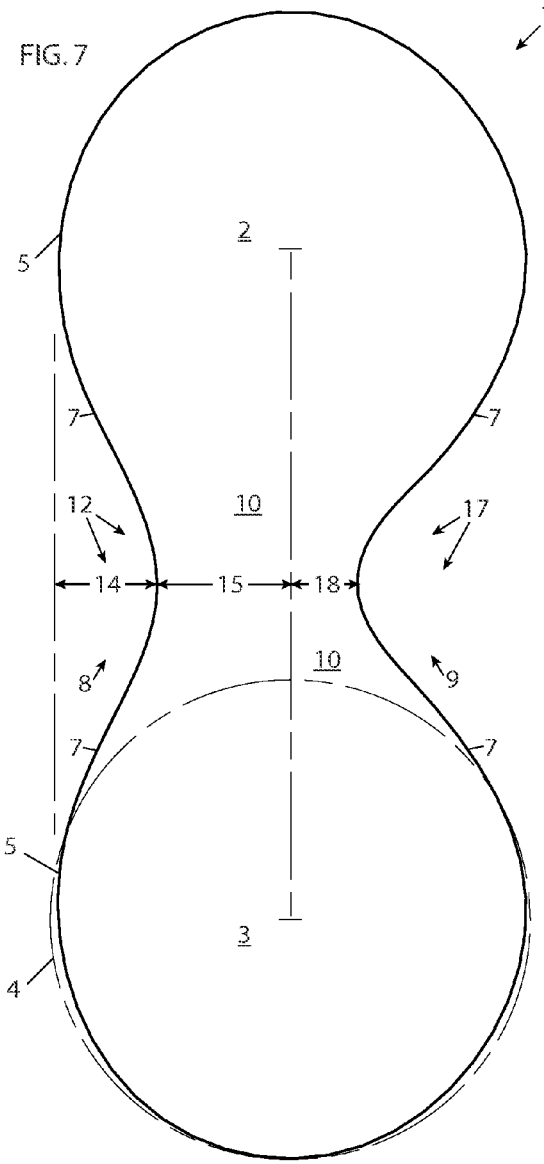
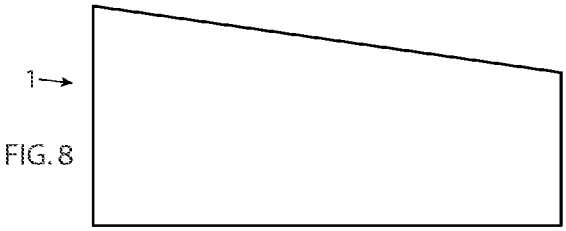
FIG. 8
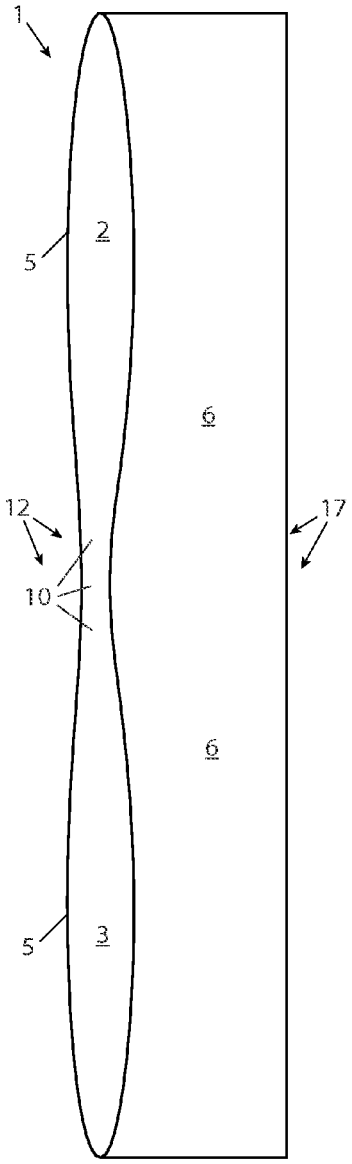
FIG. 9

FIG. 10
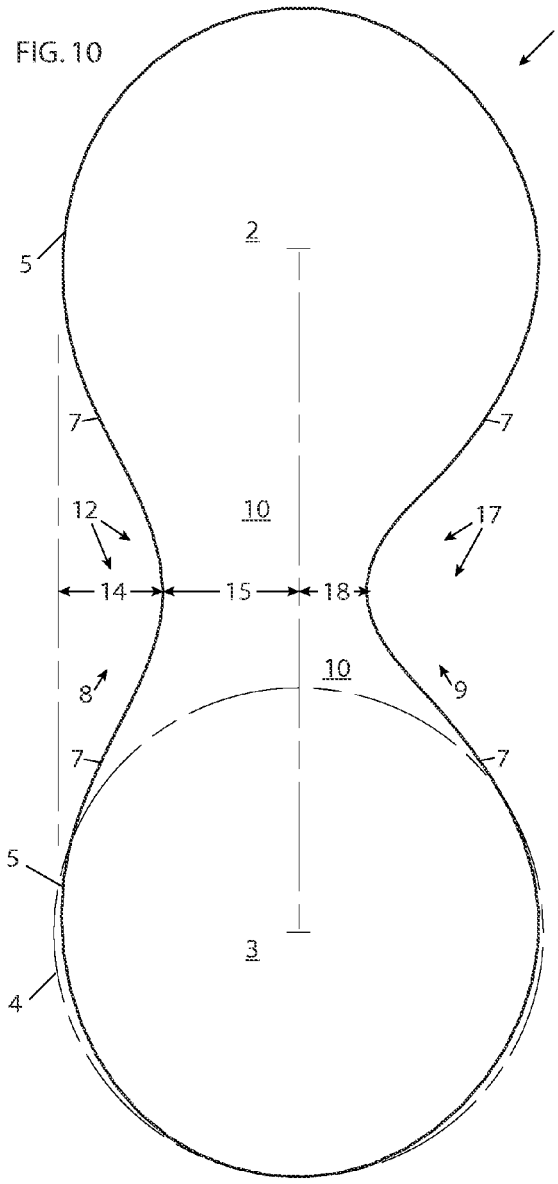
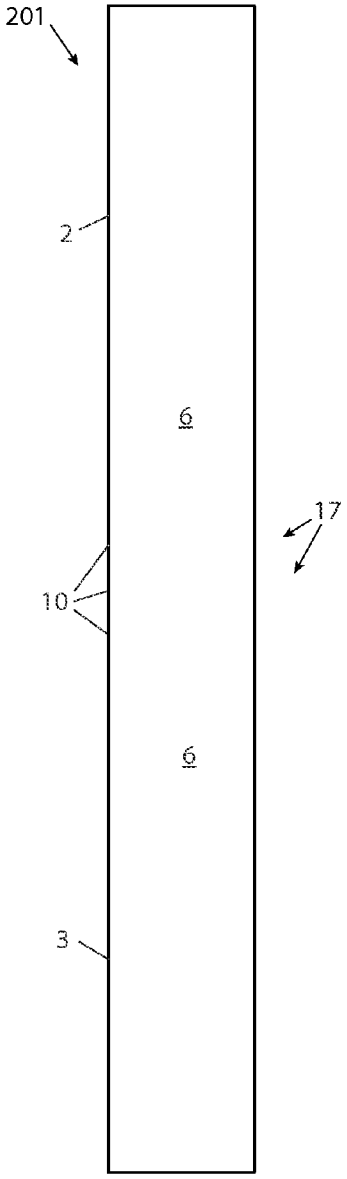
FIG. 12
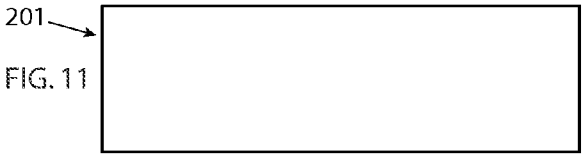
FIG. 11

FIG. 13
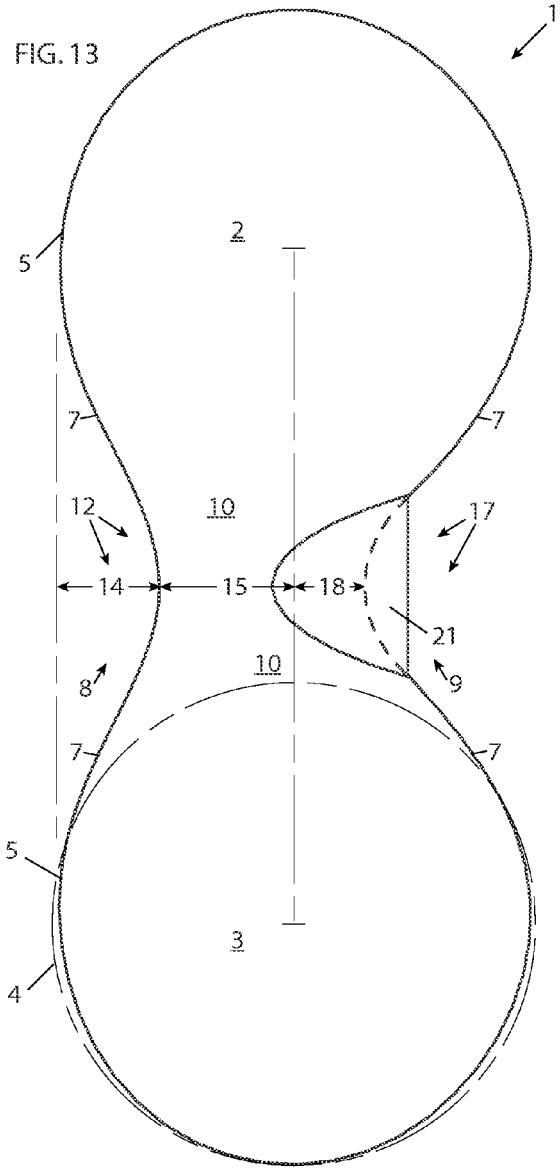
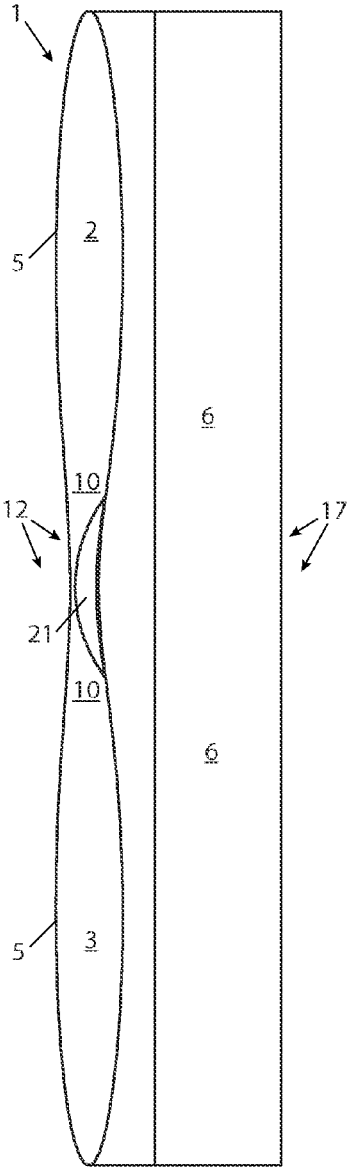
FIG. 15
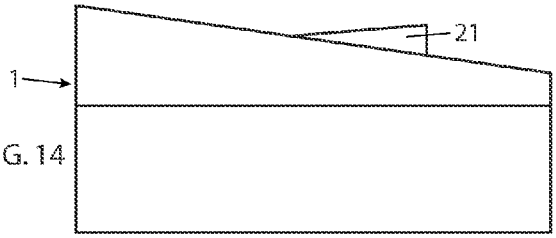
FIG. 14

FLOOR SEAT

BACKGROUND

Lotus and butterfly yoga positions are essentially sitting positions on the floor with the legs crossed, often on a thin seat, which may be referred to as a block or support or cushion.

The presently available floor seats, blocks, supports, or cushions fail to adequately conform to and provide proper separate support for the separate areas of the coccyx or tailbone, the pelvic floor or pelvic diaphragm, and the sitting bones or ischial tuberosities.

Many people practice yoga in a yoga studio located outside of their homes or offices. Yoga studios often have large groups of people practicing simultaneously. A person's practice of yoga is most likely to involve both sitting and non-sitting positions. Therefore, easy transportability and movability of any yoga seat, to and from the studio, and within the studio, are desirable features. For yoga studios, the ability to easily and conveniently store several yoga seats away and then access them again throughout the day is an additional desirable feature.

Apart from the practice of yoga, there are other circumstances where people regularly sit on the floor, such as in certain schools, institutions, and cultural traditions. The performance of certain vocational or avocational manufacturing, repair, or artistic procedures requires persons sitting on the floor. The performance of some observances of faith require persons sitting on the floor. Proper support, encouragement of proper posture, and convenient transport and storage of floor seats is desirable for those uses as well.

Ordinarily, many people sit with more or less slouched postures. Sitting in this way causes the lower spine to curve convexly with the consequence of causing an increase in the convex curve of the middle part of the back, and the head to jut forwards causing potential injury along the length of the spine, especially in the lower back and neck areas. Yoga sitting positions encourage the spine to adopt an upright posture, so that the head is balanced directly above the pelvis and the spine curved normally, that is concavely in the lower back, convexly in the middle back, and concavely in the neck. The pelvis should be in neutral alignment which promotes the ability to sit with the correct concavity of the lower spine.

Much of an individual's weight in sitting is transferred to the seat supporting him/her via the sitting bones of the pelvis. These are the lowermost extensions of the pelvis. Muscle surrounding the pelvis also transfers weight to the seat.

Pubic bones extend up and forwards from the sitting bones. Support from the seat to the pubic bones can aid good/correct posture/postural-alignment.

Depending on the shape of the seat, more or less weight is transferred by muscle and possibly fat to the coccyx, which is joined with the lower part of the sacrum. The upper part of the sacrum is joined with the lower spine. The sacrum is also joined with the pelvis by sacroiliac joints. Pressure from below on the coccyx and sacrum can disturb posture, causing undesirable torsional loading of the spine.

In yoga positions, and it other circumstances of sitting on the floor, the ability to place the heels of one's feet sufficiently close to the area of the sitting bones, pelvic floor, and pubic bone, is important, and even determinative of achieving a proper, comfortable, sustainable posture. Therefore, any seat structure impeding proper and optimal placement of one's feet works against achievement of an optimal floor-sitting position, and removal of such impediment is a beneficial element allowing achievement of a proper posture.

In most individuals, sitting on a flat surface encourages posterior pelvic tilt and an undesirable flattening of the natural lumbar lordosis or even a reversal of this curve. Sitting on a flat surface generally promotes posterior pelvic tilt forcing the lumbar spine into a flattened position as opposed to the desirable flexion, convex position. But sitting on a somewhat forward-inclined surface promotes a neutral alignment of the pelvis, that is neither tilted anteriorly nor posteriorly. As a consequence, this neutral alignment of the pelvis promotes optimal length and alignment of the spine where the three primary curves of the spine are in place—that is the backward facing curves in the lumbar (low back) and cervical (neck) areas and forward facing curve in the thoracic (mid back).

There is a need for a floor seat that will properly support both the sitting bones and the pelvic floor, while avoiding pressure on the coccyx, allowing for proper placement of the feet, and encouraging proper posture. Presently known seats fail in one or more of these areas.

US patent application No 2012/0124749 teaches "A meditation seating cushion. The seating cushion may comprise a first cushion portion, a second cushion portion separate from the first cushion portion, and a strap connecting the first and second cushion portions together. A single seating cushion portion has a substantially planar bottom surface and a substantially semi-cylindrical top surface. The cushion portions are used for disposition on a support surface such as a floor or mat, each cushion portion being underneath one of the user's buttocks, for seating the user so as to avoid imposing stress on that region of the user's bottom including the anus, perineum, and vagina or scrotum." There is no pelvic-floor support in this device.

U.S. Pat. No. 4,673,216 teaches "A seat for persons using the cross-legged "lotus" sitting position, characterized by a substantially horseshoe-shaped support with top and bottom surfaces and with a broad central portion for supporting the buttocks, and comprised of a pair of bilaterally symmetrical and divergent sections with piers extending forwardly establishing a space therebetween to lower and to position both feet and folded lower legs with the buttocks raised for comfort; a unit to be used at floor level or raised by and/or incorporated in a chair or the like." Whilst this seat provides pelvic-floor support, it can be expected to exert pressure on the coccyx. Further, I believe that uniform thickness of the piers discourages upright posture, at least without undesirable spine curvature.

In some circumstances, such as in cold or hot environments, strongly vibrating environments, or where separate insulating floor mats are not available, it is also desirable to provide thermal or vibrational insulation in a floor seat, to block or attenuate any effects on the seated person.

SUMMARY OF INVENTION

The present invention is a floor seat, particularly though not exclusively for use in the practice of yoga. My floor seat has a forward-inclined top surface and provides a pair of sitting-bone supports, a pelvic-floor support extending between the sitting-bone supports at substantially the same level, a coccyx indent behind the pelvic-floor support, and a heel indent in front of the pelvic-floor support, which in turn provide the proper amount of supporting pressure or absence of pressure appropriate to the sitting bones, the pelvic floor, and the coccyx, and room for proper placement of the feet.

My floor seat also provides ease and convenience of transport, movement, storage, and access. My floor seat also provides thermal and vibrational insulation between the floor and the seated person. Optionally, my floor seat also provides a pubic-bone positioner to remind and aid in sitting in the proper place, in the proper position, at the proper angle, and thigh supports to add to the comfort of the thighs by providing additional cushioning and insulation.

UTILITY OF INVENTION

The improved floor seat of my invention provides that which is lacking in presently known seats: the proper combination of sitting-bone supports, pelvic-floor support, a coccyx indent, a heel indent to allow proper placement of the feet, ease and convenience of transport, movement, storage, and access, and thermal and vibrational insulation between the floor and the seated person. And, optionally, a pubic-bone positioner and thigh supports. This is of benefit to individual yoga practitioners, to yoga teachers and yoga studios, and to individuals and institutions for whom periods of sitting on a floor is a necessary or traditional part of their routine, vocation, avocation, or faith.

BRIEF DESCRIPTION OF DRAWINGS

FIG. 1 is a perspective view of a first embodiment of my floor seat invention;

FIG. 2 illustrates my floor seat invention in use;

FIG. 3 illustrates the provision for stacking and storage in my floor seat invention;

FIG. 4 illustrates variations in materials contemplated in my floor seat invention, and variations in forward-inclined and flat-top embodiments;

FIG. 5 is a perspective view of a third embodiment of my floor seat invention;

FIG. 6 is a perspective view of a fourth embodiment of my floor seat invention;

FIG. 7 is a plan view of a first embodiment of my floor seat invention;

FIG. 8 is a side view of the seat of FIG. 7;

FIG. 9 is a front view of the seat of FIG. 7;

FIG. 10 is a plan view of a second embodiment of my floor seat invention;

FIG. 11 is a side view of the seat of FIG. 10;

FIG. 12 is a front view of the seat of FIG. 10;

FIG. 13 is a plan view of a third embodiment of my floor seat invention;

FIG. 14 is a side view of the seat of FIG. 13;

FIG. 15 is a front view of the seat of FIG. 13;

DEFINITIONS

Figure 16:
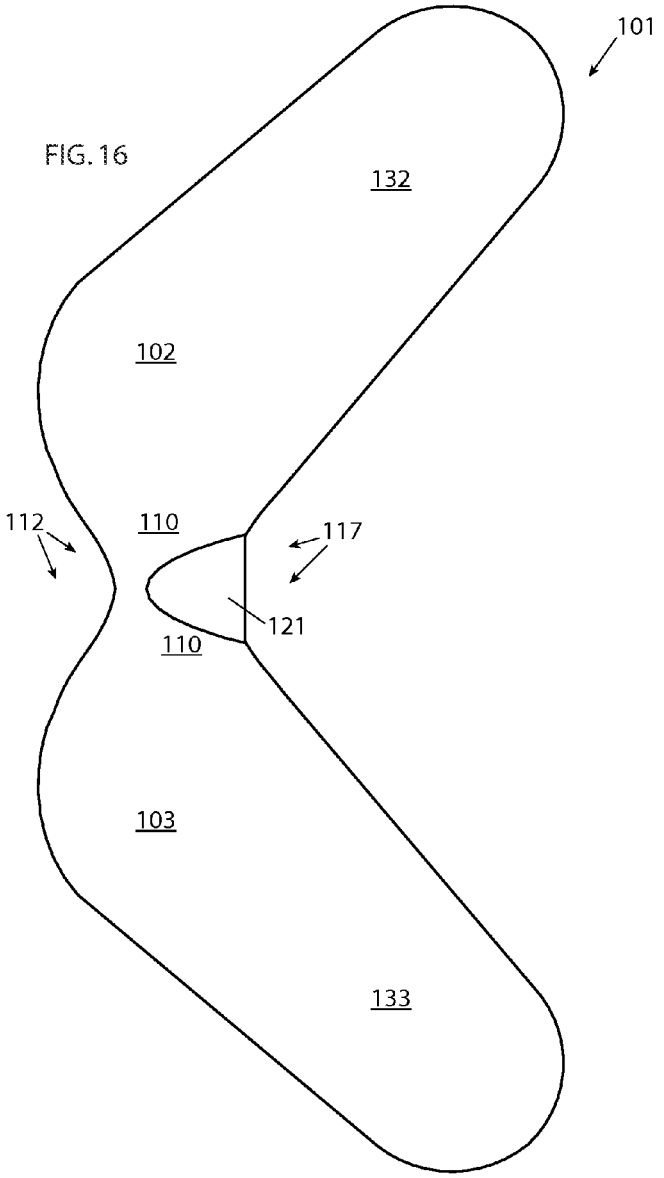
FIG. 16 is a plan view of a fourth embodiment of my floor seat invention.

"Seat" is a broad term generally referring to an object on which a person sits. One definition is: "Something, such as a chair or bench, that may be sat on". The term is used in this sense in this specification, without implication of elements such as a back to be leant against or arm supports. In this specification, parts of the human anatomy are referred to. Some have both common usage and scientific usage names. The former are preferred as follows: "hip bones" is preferred to "innominate bones"; "sitting bone" is preferred to "ischial tuberosity"; "pelvic floor" is preferred to "perineum"; and "concavity of the lower spine" is preferred to "lumbar lordosis". "Pelvis" refers to the large bony ring made up by the two hip bones and the sacrum, which are jointed at the sacroiliac joints.

Sitting-bone support is proper support of each of the two sitting bones or ischial tuberosities, the large swellings posteriorly on the superior ramus of the ischium, or knobby bone ends, that are covered by the gluteus maximus when standing, but not when sitting.

Pelvic-floor support is proper support of the pelvic floor or pelvic diaphragm, composed of muscle fibers of the levator ani, the coccygeus muscle, and associated connective tissue which span the area underneath the pelvis, important in providing support for pelvic organs, in maintenance of continence as part of the urinary and anal sphincters, and helping to maintain optimal intra-abdominal pressure.

Coccyx indent is the avoidance of pressure on the coccyx or tailbone or surrounding flesh, and avoidance of consequent unusual loading on the sacrum, which might otherwise interfere with good posture, causing undesirable torsional loading of the spine.

Heel indent is the avoidance of placing material in front of the pelvic-floor support where such material would be extraneous to support of the pelvic floor and would interfere with proper placement of the feet.

Forward-inclined top surface is the angled disposition of the top surface in relation to the bottom surface, with the back being higher than, and inclining downward to, the front, which promotes a neutral alignment of the pelvis.

Pubic-bone positioner is a posture aid or reminder for the purpose of encouraging a person to sit on the floor seat in the proper place, in the proper position, at the proper angle, by providing gentle contact and resistance against the pubic bone.

Thigh support is provision of cushioning and insulating support to the thigh area, extending past the sitting-bone areas.

DETAILED DISCLOSURE OF THE INVENTION

Referring to FIG. 1, et seq., my invention is a floor seat 1 having a forward-inclined top surface and comprising a pair of sitting-bone supports 2, 3 a pelvic-floor support 10 extending between the sitting-bone supports at substantially the same level, a coccyx indent 12 behind the pelvic-floor support, and a heel indent 17 providing space for a user's heels in use of the seat in yoga or meditation.

In use, a user's weight is reacted from the sitting-bone and pelvic-floor supports to the sitting bones and surrounding flesh and thence to the rest of the pelvis including the sacrum; whilst the coccyx indentation avoids pressure on flesh around the coccyx and consequent unusual loading on the sacrum, which might otherwise interfere with good posture, causing unusual bending and torsional loading along the spine. See FIG. 2.

The top face of my floor seat 1 should be angled forwards in relation to the bottom face. The forward-inclined top surface encourages proper posture by promoting neutral alignment of the pelvis, which in turn promotes neutral alignment of the spine, with the three primary curves in place. Whilst I can envisage as little as 5° and as much as 20°, I prefer to incline the supports by between 10° and 15°. When floor seats are used in a group, such as in a yoga studio, the seats can be stacked on each other for easy storage, turning every other angled seat upside down, as shown in FIG. 3, wherein 301 shows seats already stacked.

Referring to FIG. 4, the floor seat 1 is made from one or more firm materials 30, 40 such as high-density foam, providing the proper amount of cushioning, support, and optimally thermal and vibrational insulation, to the sitting bones and the pelvic floor of the user. The floor seat can be made of layers of different materials having different properties, such as look, feel, texture, durability, or firmness, to take advantage of combining such layers. The design of my floor seat provides support and avoidance of pressure independent of whatever material might be used. I have found my floor seat to be effective when made from balsa wood, and I expect that my floor seat made from a plastic such as high-, medium-, or low-density polyethelene, which are commonly recycled plastics used in milk jugs and similar containers, would be similarly effective.

A special embodiment of my floor seat 201 having a flat top surface provides the other benefits and support of my invention, except for the promotion of neutral alignment of the normal pelvis, and would be appropriate for persons having an injured or flattened low back, and would be useful as a booster or extender under a forward-inclined floor seat 1.

Depending on the choice of material or materials and the range of weights of the intended users, a top-to-bottom thickness, or smallest top-to-bottom thickness for angled-top floor seats, of between 40 mm and 110 mm are anticipated. Many of the embodiments illustrated here are intended to be 50 mm to 60 mm in thickness or smallest thickness, with corresponding greater thicknesses for angled tops being 78 mm to 88 mm. The largest embodiments illustrated here are intended to be 100 mm in the smallest, and 128 mm in the greater thicknesses.

Referring to FIG. 5, my floor seat can optionally provide a pubic-bone positioner 21 on the forward portion of the pelvic-floor support 10 to provide gentle contact and resistance against the pubic bone as a posture aid or reminder encouraging a person to sit on the floor seat in the proper place, in the proper position, at the proper angle.

Referring to FIG. 6, a different embodiment of my floor seat 101, optionally with a pubic-bone positioner 121, provides the additional feature of thigh supports, discussed below.

Referring to plan view FIG. 7, side view FIG. 8, and front view FIG. 9, an embodiment of my floor seat 1, is essentially Figure of Eight shaped, with lobes providing sitting-bone supports 2, 3 that are generally circular, but modified from exact imaginary circular shape 4 in that their backs 5 are somewhat flattened. Also on their sides 6 facing each other, their curvature is inflected 7 to provide smooth concave curvature 8, 9 around a pelvic-floor support 10.

The imaginary circles 4 flattened in the sitting-bone supports 2, 3 of the floor seats 1 do not touch nor intersect, but are separated by the pelvic-floor support 10, which is an area of the floor seat 1 that supports the user's pelvic floor. Preferably the sitting-bone supports and the pelvic-floor support are generally coplanar, at least when the seat is not in use. Normally the seat will be of high density foam and will deform slightly in use causing the supports to cease to be coplanar.

With reference to a projected line along the back side of the floor seat 1, the inflections 7 providing a smooth concave curvature 8 define a coccyx indent 12 in the back portion of the floor seat, having a dimension 14. In use, the user's coccyx or tailbone and surrounding flesh is positioned above the void of the coccyx indent 12, with the consequences of reduced pressure or loading being placed on the sacrum, and reduced bending and torsional loading being placed on the spine, which is the desirable posture, leading to avoidance of discomfort and injury, and attainment of the desired benefits of the floor-sitting activity.

My floor seat 1 has in addition a heel indent 17 providing space for a user's heels in use of the floor seat in yoga, meditation, or similar poses. Generally, the heel indent 17 is more extensive than the back, coccyx indent 12, because more room is needed to accommodate the heel portion of the feet than is needed for the coccyx or tailbone when a user is properly positioned on the floor seat.

With reference to a projected center-line between the centers of the near-circles of the sitting-bone supports 2, 3 and the portions of the pelvic-floor support 10 sitting to the back 15 or to the front 18 of that center-line, and the consequent depths of the coccyx indent 12 and the heel indent 17, and the relation of those indents to the center-line, the dimension 15 to the back of the center-line is optimally approximately 2 times greater than the dimension 18 to the front of the center-line. This facilitates the proper correspondence of the user's sitting bones, pelvic-floor, coccyx, and feet, with the corresponding supports or indents.

My floor seat 1 has a forward-inclined top surface, which, in use, promotes neutral alignment of the pelvis, which in turn promotes neutral alignment of the spine, with the three primary curves in place.

Plan FIG. 10, side FIG. 11, & front FIG. 12 illustrate a special embodiment of my floor seat 201 having an incline angle of 0°, which is a flat top face, which provides the basic benefits and support of my invention, except for promotion of neutral alignment of the pelvis. Such a flat embodiment of my floor seat 201 would be of benefit to persons not having a normal lumbar lordosis, but having a flattened low back due to spinal fusion or other irregularity, trauma, disease, or surgery. An inclined top surface might be painful or otherwise troublesome for such a person having a flattened low back, and the flat embodiment would avoid such trouble, yet still provide support to the sitting bones and pelvic-floor and surrounding flesh and thence to the rest of the pelvis including the sacrum, and avoid pressure on the coccyx and consequent unusual loading on the sacrum, all of which might be of particularly great benefit to such a person having a flattened low back. Another use for the flat embodiment is as a booster, insulator, or protector underneath a forward-inclined floor seat, to create a taller, more cushioned floor seat to, for example, accommodate greater weight, limited flexibility, or rough floors.

Although men and women have different configurations of pelvis and hips, they have approximately the same separation of their sitting bones. Also, the separation distance of sitting bones among individuals of different heights and builds is not very large. Therefore, it is possible to determine a target sitting-bone separation size that will accommodate, for instance, almost all adults or almost all children. Even though the pubic arches of women and men are very different, the surrounding area defined as the pelvic floor shows little variation among genders and individuals, similarly to the separation distance between sitting bones. Therefore, it is possible to determine a target pelvic-floor area size corresponding to the target sitting-bone separation size and applicable to large categories of individuals.

The sizing and the configuration of my floor seat takes into account 1) the locations where supporting material for the pubic-floor and the sitting bones must be provided, and 2) the locations where supporting material must be avoided in order to provide empty space for the coccyx and the feet. The coccyx, when seated, is always located just back of the pelvic-floor area. The most comfortable, and therefore the preferred posture has the heels of the feet just in front of the pelvic-floor area. Therefore, determination of the proper target pelvic-floor area size, and the avoidance of exceeding the front-to-back dimension of that target size, and thereby encroaching upon the empty space for the coccyx and feet, are important aspects of this invention.

The dimensions, front-to-back and side-to-side, of each of the 2 sitting-bone supports 2, 3 ought to be larger than the dimensions of the pelvic-floor support 10, in order to accommodate some variation in the separation distance of sitting bones and the position of the sitting bones relative to the position of the pelvic floor. Because there is no need to provide empty space around the sitting-bone supports, there is no disadvantage to providing larger sitting bone supports.

In order to provide the proper amount of empty space in the proper positions for the coccyx and feet while providing proper support in the proper positions for the pelvic floor and the sitting bones, the pelvic-floor support 10 is offset toward the back of a center line between the centers of the 2 nearly circular sitting-bone supports 2, 3. The distance 15 from such a center line to the closest back edge of the pelvic-floor support is approximately twice the distance 18 to the closest front edge. Consequently, the maximum depth relative to the center line of the heel indent 17 is approximately twice that of the coccyx indent 12.

The exact measurements of the various parts may vary somewhat without losing their effectiveness, and floor seats for persons of significantly different size, such as children, can be adjusted proportionally. Allowing for variation in the measurements, an embodiment of the floor seat 1 appropriate for the normal range of normal adult sizes is: a total of 382 mm wide, imaginary circles encompassing the sitting-bone supports of 165 mm diameter, a separation of the centers of the imaginary circles encompassing the sitting-bone supports of 222 mm, a greatest front-to-back measurement of 156 mm, a smallest front-to-back measurement (at the pelvic-floor support 10) of 65 mm, a center-line-to-heel-indent 17 measurement 18 of 22 mm, and a center-line-to-coccyx-indent 12 measurement of 43 mm, resulting in a back-line-to-coccyx indent 12 distance 14 of 34 mm, and a front-line to heel indent distance of 57 mm.

It should be noted that the above dimensions are exemplary only. My experiments have indicated that the above dimensions are suitable. I can envisage variations of these dimensions of up to 25% for normal adults of normal sizes remaining effective. And for children and other persons of significantly different size, I expect that the stated dimensions will be altered in proper proportion. I also expect individual users to experiment and find the best position for each to sit with respect to the back concavity.

Plan FIG. 13, side FIG. 14, & front FIG. 15 illustrate an embodiment having an optional pubic-bone positioner 21 provided on the forward portion of the pelvic-floor support 10 to provide gentle contact and resistance against the pubic bone as a posture aid or reminder for the user to sit on the floor seat in the proper place, in the proper position, at the proper angle. The pubic-bone positioner 21 is made of a fairly flexible and yielding material, to exert only gentle pressure on the pubic bone of a user sitting too far forward on the floor seat. The pubic-bone positioner 21 can optionally extend into the heel indent 17, or, as illustrated, extend above the heel indent 17.

The pubic-bone positioner 21 is positioned centrally between the sitting-bone supports. It is not intended to support the user's weight, but rather act as a posture aid. As such it has a convex shape when viewed from the side and length from side to side to enable it to bridge both pubic bones. Its height and position is variable in accordance with the fact that the pubic bones slope up forwards. The pubic-bone positioner 21 could be a part-spherical dome having a 45 mm radius of curvature, centred 55 mm in front of the center-line. The front of the dome may be extended down to blend in with the curvature of the heel indent 17. The pubic-bone positioner 21 could be wedge shaped, sloping upwards towards the front, in other words sloping in the opposite direction to the inclination angle, if any, of the top surface. The pubic-bone positioner inclination can be of the order of 30° to the upper surface of the sitting-bone supports. I envisage the wedge to be of the order of 60 mm back to front, rising from 10 mm in front of the center line and of the order of 75 mm wide, preferably with its side edges chamfered.

Figure 17:
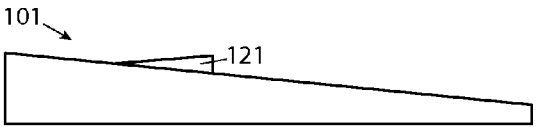
FIG. 17 is a side view of the seat of FIG. 16.
Figure 18:
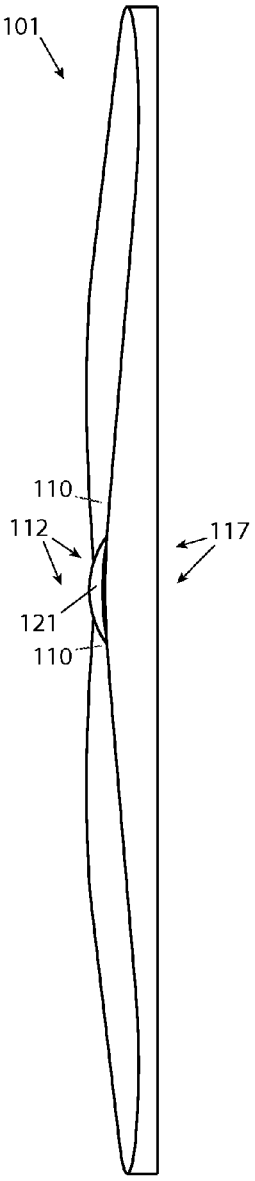
FIG. 18 is a front view of the seat of FIG. 16.

Referring to plan view FIG. 16, side view FIG. 17, and front view FIG. 18, a different embodiment of the floor seat 101 of my invention is shown. Like the other embodiments, it has sitting-bone supports 102, 103, a pelvic-floor support 110, a smoothly-curved coccyx indent 112 at the back, a smoothly-curved heel indent 117 for the heels, a forward-inclined top surface, and optionally a pubic-bone positioner 121. In addition this embodiment further provides extended thigh supports 132, 133.

The thigh supports 132, 133 provide additional cushioning and thermal and vibrational insulation for the user's thighs or upper legs, which might be desirable in circumstances where, for instance, no yoga mat nor other cushioning floor covering is used under the floor seat 101, and the floor is hard, cold, vibrating, or otherwise uncomfortable.

The sitting-bone supports 102, 103 are extended by thigh supports 132, 133. These are the same width as the transverse dimension of the sitting-bone supports of the first embodiment, namely 156 mm. They are substantially straight and set at 90° to each other, that is 45° to the center line. This latter is not the center-line of the pelvic-floor support, but is between where the centers of the sitting-bone supports would be in the absence of the thigh supports. The distal ends of the thigh supports are rounded and the supports have a length along their center-lines of 360 mm, including the sitting-bone supports. In use of the seat, the thigh supports support the user's thighs.

The thigh supports optionally taper in their thickness to give the seat a forwards inclination, as seen in FIG. 17. I prefer to provide 10° of inclination although as much as 12.5° and as little as 5° is feasible. Less than 5° is of negligible benefit and much more than 12.5° is liable to reduce the thickness of the thigh supports to nothing, at least without thickening the seat at the sitting-bone supports.

While this invention has been described in detail with particular reference to its preferred embodiments, the principles and modes of operation of the invention have also been described in this specification. The invention should not be construed as being limited to the particular forms disclosed, which are illustrative rather than restrictive. Modifications, variations, and changes may be made by those skilled in the art without departure from the spirit and scope of the invention as described by the following claims.

I claim:

1. A floor seat for persons having a target pelvic-floor area size and a corresponding target sitting-bone separation size, comprising:

a pelvic-floor support having a front, back, 2 sides, top, and bottom, having front-to-back and side-to-side dimensions of said target pelvic-floor area size;

a pair of sitting-bone supports extending one from each side of said pelvic-floor support, having front-to-back and side-to-side dimensions larger than said pelvic-floor support, having a center-to-center separation distance of said target sitting-bone separation size, located symmetrically to each other and offset toward the front of said pelvic-floor support;

a coccyx indent empty space centered on and defined by the back of said pelvic-floor support; a heel indent empty space centered on and defined by the front of said pelvic-floor support; and a forward-inclined top surface;

where said dimensions and relative positions of said pelvic-floor support and said sitting-bone supports provide support to a person's pelvic-floor and sitting bones, said coccyx indent and said heel indent provide empty spaces to accommodate a person's coccyx areas and the heels of a person's feet, and said forward-inclined top surface promotes neutral alignment of the pelvis in turn promoting neutral alignment of the spine, wherein the three primary curves of said spine are in place.

2. The floor seat of claim 1, further comprising a pubic-bone positioner on the top center front portion of said pelvic-floor support.

3. The floor seat of claim 1, further comprising a pair of thigh supports extending from said sitting-bone supports.

4. The floor seat of claim 1, further comprising being made from at least one cushioning but firm material providing the proper amount of cushioning and support to said person's pelvic floors and sitting bones.

5. The floor seat of claim 1, further comprising being made from at least on cushioning but firm material providing the proper amount of cushioning, support, thermal insulation, and vibrational insulation to said person's pelvic floors and sitting bones.

6. The floor seat of claim 1, further comprising being made from at least one high-density foam.

7. The floor seat of claim 1, further comprising being made with layers of different cushioning but firm materials.

8. The floor seat of claim 1, where a center line between the centers of said sitting-bone supports falls twice as far from the back of said pelvic-floor support than from the front.

9. The floor seat of claim 1, where the tops and bottoms of said pelvic-floor support and said sitting-bone supports are at substantially the same levels when not in use.

10. The floor seat of claim 1, where said pelvic-floor support and said sitting-bone supports are generally coplanar when not in use.

11. The floor seat of claim 1, where said forward-inclined top surface is angled in relation to the surface of said bottom, with said back being higher than said front, where said inclination is between 5° and 20°.

12. The floor seat of claim 1, where said forward-inclined top surface is angled in relation to the surface of said bottom, with said back being higher than said front, where said inclination is between 10° and 15°.

13. The floor seat of claim 1, where said coccyx indent and said heel indent are smoothly curved.

14. The floor seat of claim 1, where groups of said floor seats can be stacked on each other for easy storage, turning every other angled seat upside down.

15. The floor seat of claim 1, where the smallest top-to-bottom thickness is between 40 mm and 110 mm.

16. The floor seat of claim 1, where the smallest top-to-bottom thickness is between 50 mm and 60 mm.

17. The floor seat of claim 1, where the greatest top-to-bottom thickness is between 78 mm and 128 mm.

18. The floor seat of claim 1, further comprising:

being made from at least one high-density foam;

where total side-to-side width of said floor seat is 382 mm, separation of the centers of said sitting-bone supports is 222 mm, greatest front-to-back measurement at said sitting-bone supports is 156 mm, smallest front-to-back measurement at said pelvic-floor support is 65 mm, distance from a center line between the centers of said sitting-bone supports is 22 mm from the closest point on the front face of said pelvic-floor support at said heel indent, and is 43 mm from the closest point on the back face of said pelvic-floor support at said coccyx indent, resulting in a coccyx indent of 34 mm and a heel indent of 57 mm.

19. A floor seat for persons having a target pelvic-floor area size and a corresponding target sitting-bone separation size, comprising:

a pelvic-floor support having a front, back, 2 sides, top, and bottom, having front-to-back and side-to-side dimensions of said target pelvic-floor area size;

a pair of sitting-bone supports extending one from each side of said pelvic-floor support, having front-to-back and side-to-side dimensions larger than said pelvic-floor support, having a center-to-center separation distance of said target sitting-bone separation size, located symmetrically to each other and offset toward the front of said pelvic-floor support;

a coccyx indent empty space centered on and defined by the back of said pelvic-floor support;

and a heel indent empty space centered on and defined by the front of said pelvic-floor support; where said dimensions and relative positions of said pelvic-floor support and said sitting-bone supports provide support to a person's pelvic-floors and sitting bones, and said coccyx indent and said heel indent provide empty spaces to accommodate a person's coccyx areas and the heels of a person's feet.

20. The floor seat of claim 19, further comprising:

being made from at least one high-density foam;

where total side-to-side width of said floor seat is 382 mm, separation of the centers of said sitting-bone supports is 222 mm, greatest front-to-back measurement at said sitting-bone supports is 156 mm, smallest front-to-back measurement at said pelvic-floor support is 65 mm, distance from a center line between the centers of said sitting-bone supports is 22 mm from the closest point on the front face of said pelvic-floor support at said heel indent, and is 43 mm from the closest point on the back face of said pelvic-floor support at said coccyx indent, resulting in a coccyx indent of 34 mm and a heel indent of 57 mm.

* * * * *